US008375528B2

(12) United States Patent
Takazawa et al.

(10) Patent No.: US 8,375,528 B2
(45) Date of Patent: Feb. 19, 2013

(54) WATER REPELLENT SLIDER CAP FOR ZIPPERS

(75) Inventors: Shigeyoshi Takazawa, Anaheim, GA (US); Dennis T. Bernabe, Anaheim, CA (US)

(73) Assignee: YKK Corporation (JP)

( * ) Notice: Subject to any disclaimer, the term of this patent is extended or adjusted under 35 U.S.C. 154(b) by 510 days.

(21) Appl. No.: 12/628,813

(22) Filed: Dec. 1, 2009

(65) Prior Publication Data

US 2011/0126383 A1 Jun. 2, 2011

(51) Int. Cl.
*A44B 19/32* (2006.01)

(52) U.S. Cl. ..... 24/387; 24/389; 24/436

(58) Field of Classification Search ..... None
See application file for complete search history.

(56) References Cited

U.S. PATENT DOCUMENTS

| | | | | |
|---|---|---|---|---|
| 2,928,156 | A * | 3/1960 | Doelter et al. | 24/388 |
| 3,005,247 | A * | 10/1961 | Doelter | 24/389 |
| 4,368,562 | A * | 1/1983 | Minami | 403/354 |
| 4,873,750 | A * | 10/1989 | Tracy | 24/429 |
| 6,998,082 | B2 | 2/2006 | Yang | |
| 7,591,051 | B2 * | 9/2009 | Kusayama et al. | 24/387 |
| 2004/0020017 | A1 * | 2/2004 | Nedbal et al. | 24/429 |
| 2005/0040559 | A1 | 2/2005 | Yang | |
| 2007/0113384 | A1 | 5/2007 | Ortlieb | |

FOREIGN PATENT DOCUMENTS

| | | |
|---|---|---|
| GB | 440781 | 1/1936 |
| GB | 2386641 A | 9/2003 |
| JP | 2006-61378 A | 8/2004 |

OTHER PUBLICATIONS

European Search Report, European Patent Application No. 10252038.4, mailed Apr. 20, 2012.

* cited by examiner

*Primary Examiner* — Jack W. Lavinder
(74) *Attorney, Agent, or Firm* — Kilpatrick Townsend & Stockton LLP

(57) ABSTRACT

Water repellent slider caps and zipper structures. Certain embodiments provide a male slider cap that receives a slider to thereby reduce the amount of water introduced around the perimeter of the slider. A pull tab on the slider may be inserted into a pocket on the male slider cap that is defined by the inner surface of the male slider cap and a snap tab. In other embodiments there is additionally provided a garage attached to the zipper tape. The garage may receive the male slider cap to reduce the amount of water around the perimeter of the slider and into the garage. Certain other embodiments provide a female slider cap to receive a second slider that may be positioned on the zipper tape. The female slider cap may receive the leading edge of the male slider cap, thus covering any open spaces between the first and second sliders.

7 Claims, 10 Drawing Sheets

WATER REPELLENT SLIDER CAP FOR ZIPPERS

FIELD OF THE INVENTION

The invention relates generally to slider caps that snap onto a slider of a zipper to thereby provide improved water repellent zippers and zipper structures.

BACKGROUND OF THE INVENTION

Objects that include zippers may be exposed to wet conditions such that water penetrates into open spaces or crevices of the zipper. For example, there may be zippers on luggage, other types of bags, outerwear, or jackets that are exposed to the rain or snow, or are otherwise used in a wet environment (such as on boats or otherwise near the water). In such environments water may penetrate the zipper and seep into the surface underneath the zipper. The contents of the luggage and/or bags may become wet and damaged, and a person wearing the outerwear might become uncomfortable and cold.

Water repellent zippers are known that decrease the amount of water that penetrates between the teeth and/or zipper tape of a zipper. Such zippers may include polyurethane lamination on the zipper tape or specially-shaped teeth, both of which provide a barrier to decrease water penetration into the zipper. But water may also penetrate into the gap that appears between the zipper slider and an end piece of the zipper. For example, coil zippers typically have a metal crimp at the end piece. When the slider is pulled up to fully engage the zipper, then the leading edge of the slider contacts the end piece; however, an open space or gap may be created between the slider and the end piece. Also, as shown in FIGS. 4 and 5, in some applications there are two sliders that meet in a head-to-head configuration on the same zipper. In such configurations the two sliders contact one another and an open space may be created on either side of the point of contact between the two sliders. Water and other elements may penetrate the open spaces created by the sliders.

Products have been created in an attempt to improve the water repellent properties of zippers. For example, some products fastened a hood to the zipper tape. The hood had an open edge and the slider was placed inside the hood in order to cover the slider. But it was difficult to fully engage the zipper in these designs because the pull tab on the slider would contact the edge of the hood, preventing the user from pulling the pull tab up all the way. Thus, the user must push the slider into the hood, which may be cumbersome or difficult for some users. In general such designs had poor engagement between the hood and the slider.

Thus, there is a need to provide an improved covering (or garage) in which to dock the slider of a zipper. Specifically, there is a need to provide improved engagement between the slider and the garage, which may lead to improved water-repellant properties. Furthermore, there is a need to improve the water repellent properties of sliders that are arranged in a head-to-head configuration.

SUMMARY OF THE INVENTION

In certain embodiments there is provided a water repellent zipper assembly comprising water repellent zipper tape, a slider comprising a leading edge and a pull tab, and a slider cap. The slider cap may comprise an outer surface, an inner surface opposite the outer surface, a leading edge, a first sidewall adjacent to the leading edge, a second sidewall adjacent to the leading edge and opposite the first sidewall, and a snap tab extending between at least a portion of an inner surface of the first and second sidewalls. The inner surface of the slider cap and the snap tab may define a pocket that receives the pull tab of the slider. Thus, the outer surface of the slider cap may cover the slider, and the leading edge of the slider cap may extend beyond the leading edge of the slider, to reduce the amount of water introduced around the perimeter of the slider.

In other embodiments there may additionally be provided a garage that is attached to the zipper tape. The garage may comprise an outer surface, an inner surface opposite the outer surface, at least three sidewalls, and an aperture. The slider and the slider cap may be inserted into the aperture of the garage such that the inner surface of the garage contacts the outer surface of the slider cap. The contact between the garage and the slider cap improves engagement between the two parts, which may reduce the amount of water introduced around the perimeter of the slider and into the garage.

In still other embodiments there may be provided two sliders arranged in a head-to-head configuration. A male slider cap as described above may receive and cover the first slider to thereby reduce the amount of water introduced around the perimeter of the first slider. Additionally, there may be provided a female slider cap to cover and repel water from the second slider. The female slider cap may comprise an outer surface, an inner surface opposite the outer surface, a leading edge adjacent to an aperture, a first sidewall adjacent to the leading edge, a second sidewall adjacent to the leading edge and opposite the first sidewall, and a snap tab extending between at least a portion of an inner surface of the first and second sidewalls. The inner surface of the female slider cap and the snap tab may define a pocket that receives the pull tab of the second slider. Thus, the outer surface of the female slider cap may cover the second slider, and the leading edge of the female slider cap may extend beyond the leading edge of the second slider, to reduce the amount of water introduced around the perimeter of the second slider. Moreover, the leading edge of the male slider cap may be inserted into the aperture of the female slider cap to reduce the amount of water introduced around the respective leading edges of the first and second sliders.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE INVENTION

Figure 1B:
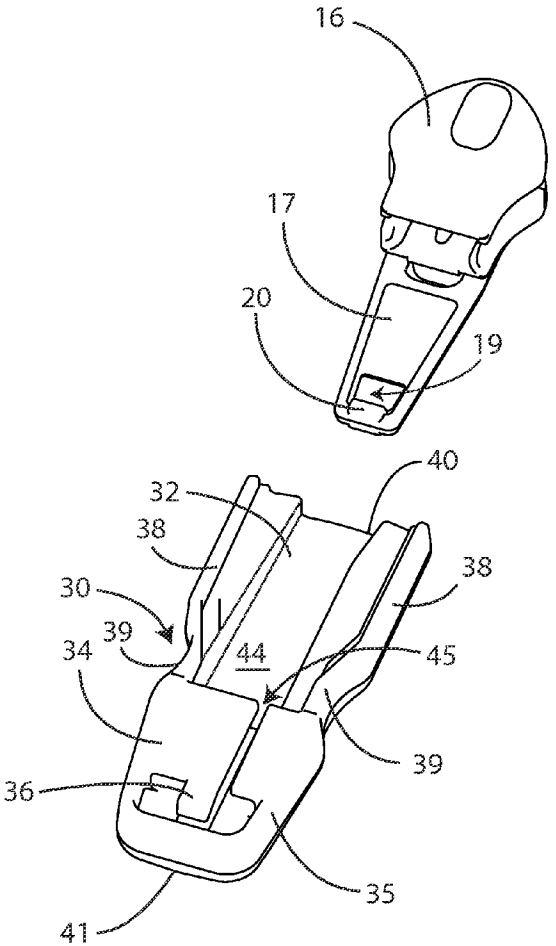
FIGS. 1A-1C show perspective views of a male slider cap and a slider according to certain embodiments of the invention.
Figure 1A:
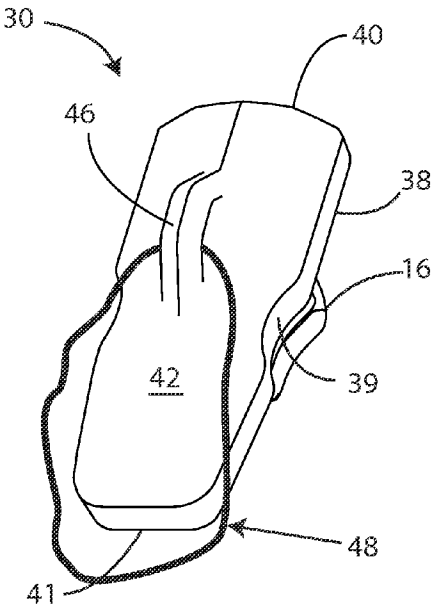

According to certain embodiments of the invention there is a male slider cap 30 that snaps onto the slider 16 of a zipper to provide improved water repellent properties. As shown in FIG. 1B, the pull tab 17 is inserted into the male slider cap 30 starting on the leading edge 40 of the male slider cap 30 and proceeding towards the trailing edge 41. The pull tab 17 is received in a pocket 45 that is defined between a snap tab 34, 35 and the inner surface 44 of the male slider cap 30. The snap tab 34, 35 extends from the inner surfaces of the sidewalls 38 of the male slider cap 30. As shown in FIG. 1C the snap tab 34, 35 spans substantially the entire width of the male slider cap 30. Thus, a pocket 45 is created between the snap tab 34, 35 and the inner surface 44 of the male slider cap 30. This pocket 45 receives the pull tab 17 of the slider 16. In certain embodiments the snap tab is composed of two separate portions—a first portion 34 and a second portion 35—that are separated from each other by a small gap. In other embodiments, however, the snap tab comprises a single element and does not have a separating gap. For ease of reference this disclosure will refer to the snap tabs 34, 35 as comprising two portions, although it should be understood that the disclosure is in no way limiting and the snap tab may comprise a single element.

Figure 1D:
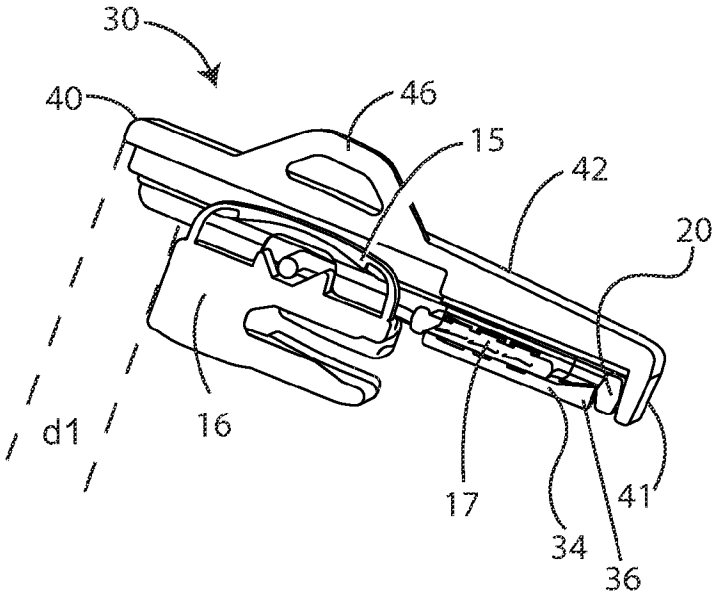
FIG. 1D is a cross-sectional view of the male slider cap and slider as shown in FIGS. 1A-1C.
Figure 1C:
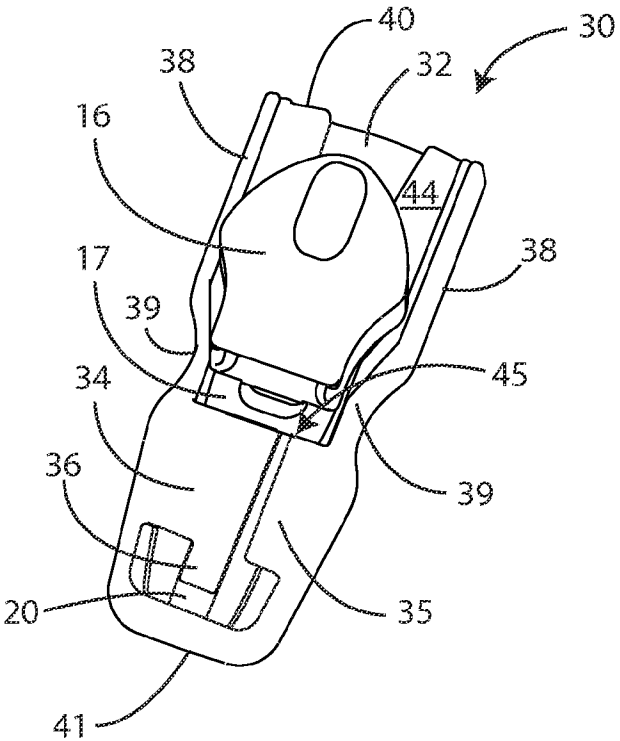
Figure 2C:
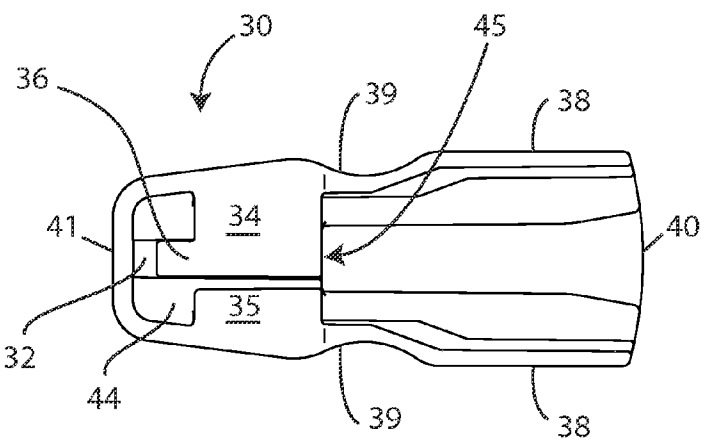
FIGS. 2A-D show various views of the male slider cap as shown in FIGS. 1A-1D.
Figure 2D:
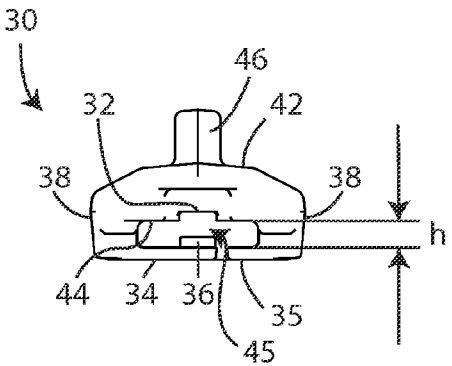
Figure 2A:
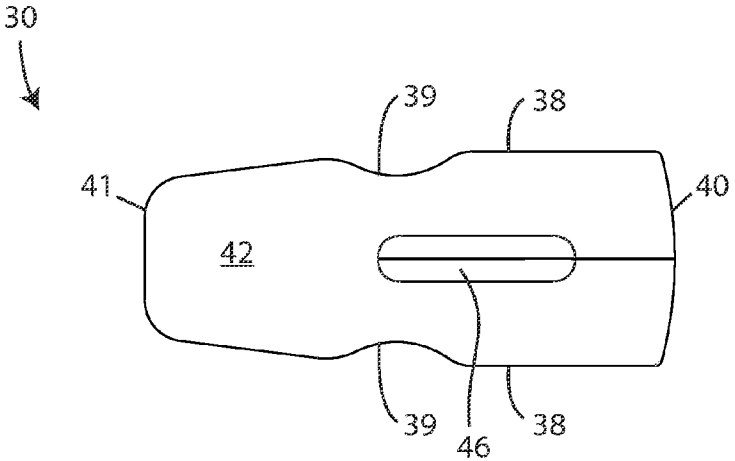
Figure 2B:
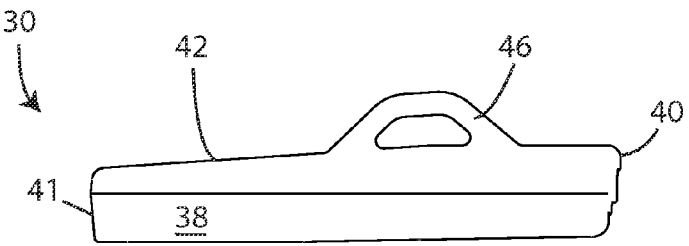

As shown in FIGS. 1D and 2D the first portion of the snap tab 34 includes a ramp 36 that is slightly inclined from the remaining portions of the snap tab 34. The ramp 36 is dimensioned such that it fits into an aperture 19 that may be provided on some pull tabs 17. The aperture 19 is illustrated in FIG. 1B, which also shows a bump 20 that may be provided adjacent to the aperture 19 on the back side of the pull tab 17. FIG. 1C shows how the ramp 36 fits into the aperture 19. As the pull tab 17 is inserted into the pocket 45 of the male slider cap 30, the leading edge of the pull tab 17 begins to travel up the ramp 36. When fully inserted the ramp 36 snaps into the aperture 19 of the pull tab 17. The small gap between the portions of the snap tab 34, 35 allows the portions to flex independently of one another such that the ramp 36 can snap into the aperture 19 on the pull tab 17. Also, the bump 20 is fixed on the opposite side of the ramp 36, and the bump 20 further prevents the pull tab 17 from pulling out of the pocket 45. The pull tab 17 is thus snapped within the male slider cap 30 by the fit between the ramp 36 and the aperture 19 and bump 20 of the pull tab 17.

Water repellent properties are improved by the male slider cap 30. First, the outer surface 42 of the male slider cap 30 covers the slider 16 to thereby cover any open spaces that may be around the perimeter of the slider 16. As shown in FIG. 1D, the leading edge 40 of the male slider cap 30 protrudes a distance (d1) from the slider 16. This distance (d1) of the male slider cap 30 provides an over-hanging portion that covers any open spaces that may be created between the slider 16 and the end piece 18 of the zipper. In general, as the size of the male slider cap 30 increases, so does the size of the perimeter around the slider 16 that is covered by the male slider cap 30, as shown in FIG. 1A. Thus, more or less water repellent properties may be achieved by modifying the size of the male slider cap 30 as desired.

The water repellent properties are also improved by the two sidewalls 38 and the trailing wall 41 of the male slider cap 30. For example, the walls extend down the height (h) and cover any open spaces that might be formed around the perimeter of the slider 16. But the walls 38, 41 also provide other functions for the male slider cap 30. For example, the walls 38, 41 may provide for a secure fit with the pull tab 17 and the slider 16. And in certain embodiments the sidewalls 38 may include a concave portion 39 that serves as a finger grip that a user may grasp when engaging the slider cap 30.

As shown in FIG. 1D, traditional sliders 16 include a crown 15 to which the pull tab 17 is fastened. This crown 15 protrudes above the main body of the slider 16. Thus, male slider caps 30 according to some embodiments may include a domed outer surface 42 to accommodate the crown 15 of the slider 16. Additionally, as shown in FIG. 2D there may be provided a crown clearance portion 32 on the inner surface 44 of the male slider cap 30. The crown clearance portion 32 provides clearance between the crown 15 of the slider 16 and the inner surface 44 of the male slider cap 30. In certain embodiments the crown clearance portion 32 may be dimensioned so as to serve as a guide to facilitate the insertion of the pull tab 17, as shown in FIG. 1B.

Certain embodiments of the male slider cap 30 also include a crown 46 that serves as an anchor for a cord puller 48. The crown 46 may be any dimension or shape that is sufficient to receive the cord puller 48. In some embodiments the crown 46 of the male slider cap 30 is positioned generally above the crown 15 and main body of the slider 16, as shown in FIG. 1D. In other embodiments described herein, however, a female slider cap 62 may include a crown 80 with different placement (and shapes). Finally, the cord puller 48 may be composed of a variety of materials, such as but not limited to fabric, woven strands, a metal chain, or a leather cord.

Slider caps according to embodiments of the invention (either male or female slider caps 30, 62) may be composed of a variety of materials, including but not limited to hard plastic such as acetal or various metals. Harder materials for the slider caps 30, 62 help to maintain the secure fit and snapping action on the pull tab 17. Depending on the application, it may be desirable to make the slider caps 30, 62 with a material that is ultra-violet resistant or that has a particular color fastness. The slider caps 30, 62 may be manufactured by a variety of processes, including but not limited to injection molding.

Figure 3B:
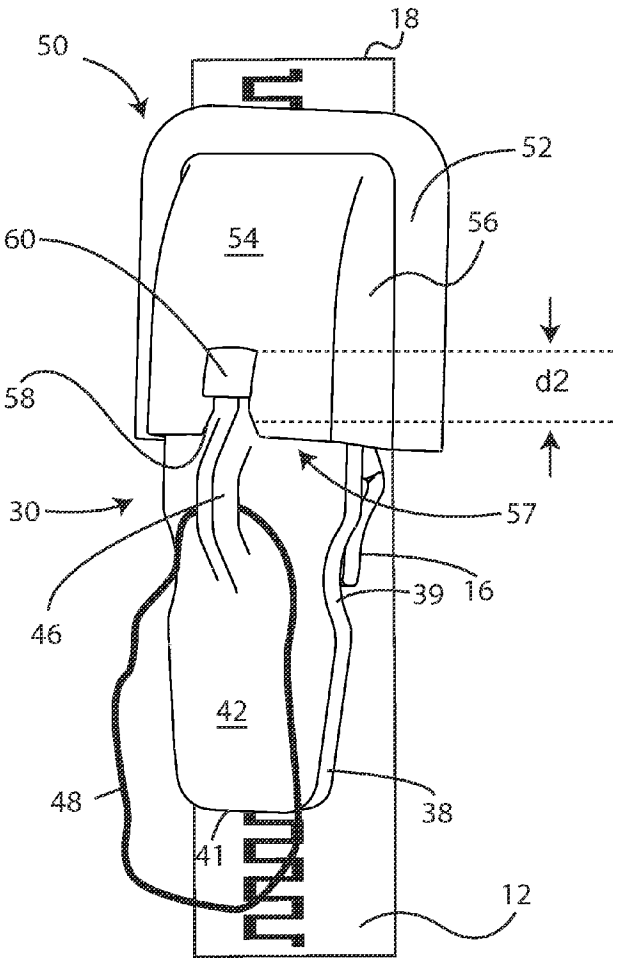
FIGS. 3A and 3B show examples of a garage, and a male slider cap docking in the garage, according to certain embodiments of the invention.
Figure 3A:
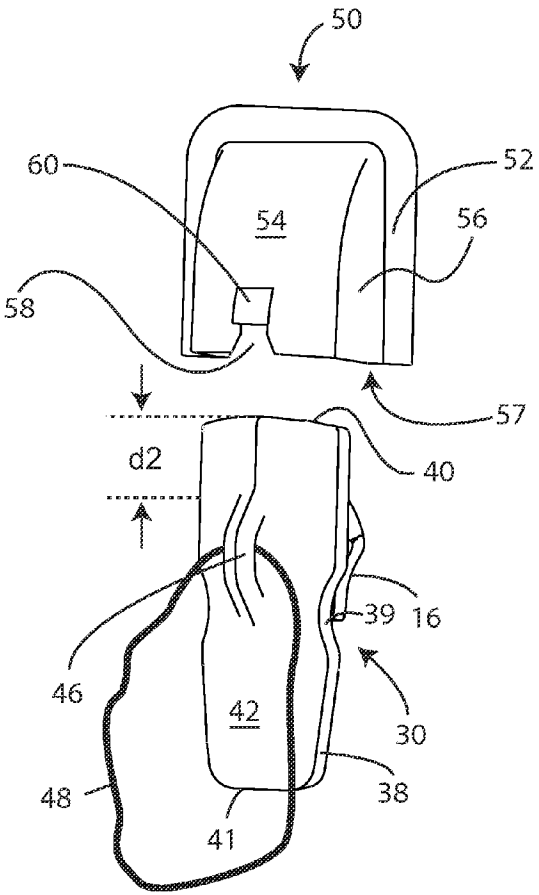
Figure 3C:
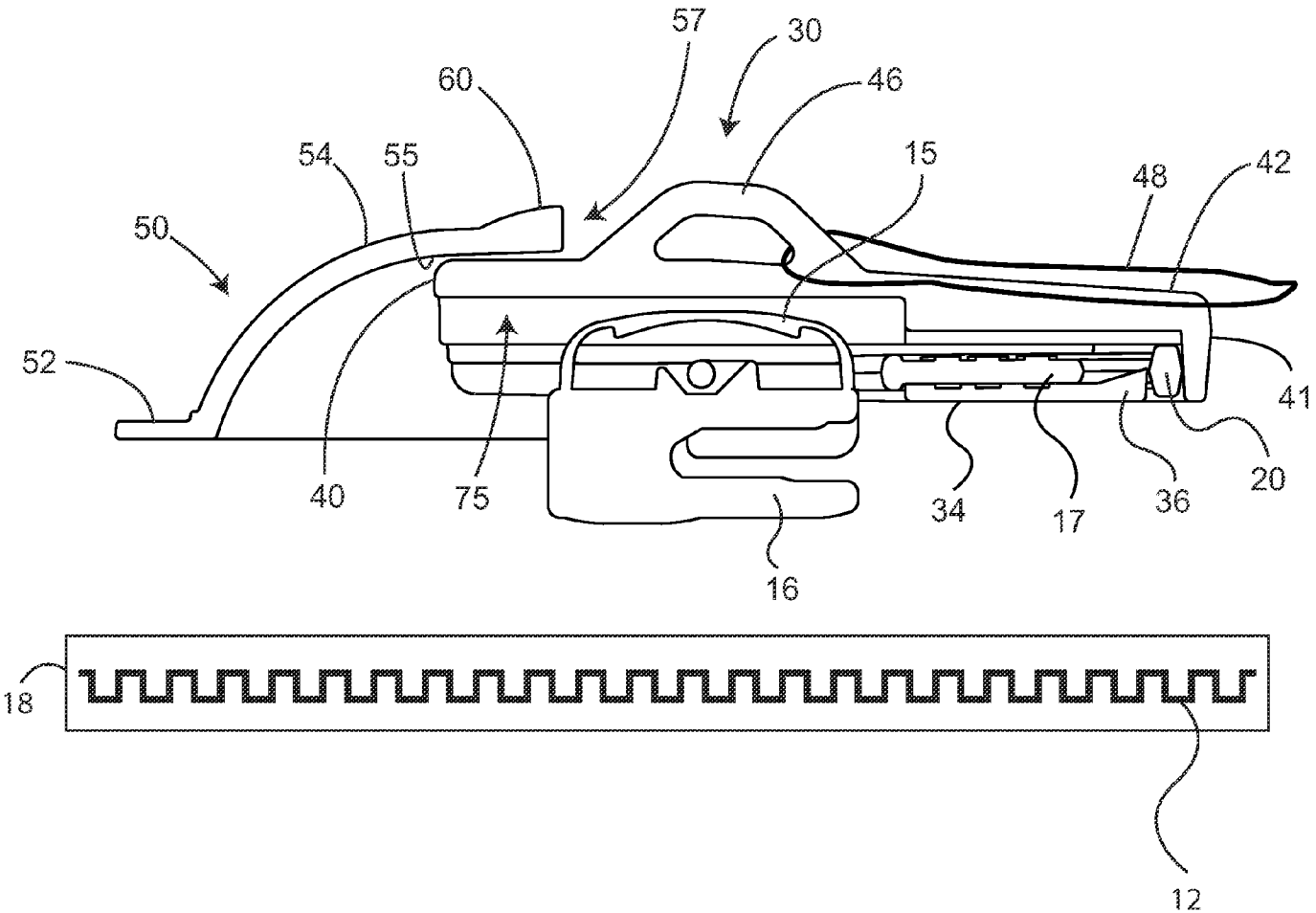
FIG. 3C shows a cross-sectional view of a male slider cap docked in a garage according to certain embodiments.

Certain embodiments may also include a garage 50 in which to dock the male slider cap 30. Such embodiments are illustrated in FIGS. 3A-C. It should be understood that in actual operation the slider 16 and garage 50 in each of FIGS. 3A-C would be attached to zipper tape 12; however, the zipper tape 12 is not shown in FIG. 3A in order to better illustrate the particular features of the slider 16, male slider cap 30, and garage 50. The zipper tape 12 is shown in FIGS. 3B and C.

The garage 50 has at least one mounting edge 52, an outer surface 54, inner surface 55, sidewalls 56, and an aperture 57 in which to dock the male slider cap 30. As shown in FIG. 3B, the garage 50 may be attached to the zipper tape 12 along its mounting edge 52 by any method known to those of skill in the art, including but not limited to sewing, RF welding, gluing, stapling, or taping. The garage 50 may be attached anywhere along the length of a zipper tape 12, including but not limited to the end piece 18 of the zipper 10. If the garage 50 is attached adjacent to the end piece 18, the garage 50 may cover any open spaces that are formed near the end piece 18.

The garage 50 may be composed of a variety of materials. In some embodiments the garage 50 may be composed of a material that is softer and more pliable than the material of the male slider cap 30. Pliable materials for the garage 50 might be desired in embodiments wherein the garage 50 will be subjected to forceful impacts. Such pliable materials may simply bend and deform under impact, whereas harder materials might become damaged. For example, the garage 50 may be composed of rubber, silicone, fabric, or laminated fabric.

To dock the male slider cap 30 in the garage 50, the leading edge 40 of the male slider cap 30 is inserted into the aperture 57 of the garage 50. As shown in FIG. 3C, when docked, the inner surface 55 of the garage 50 contacts the outer surface 42 of the male slider cap 30. This contact improves engagement between the garage 50 and the male slider cap 30. Additionally, in certain embodiments the garage 50 may be made of a material with a high coefficient of friction (such as rubber or silicone). Thus, the inner surface 55 of the garage 50 may "stick to" or otherwise have a friction fit with the outer surface 42 of the male slider cap 30, which may further improve engagement between the garage 50 and the male slider cap 30. Such improved engagement may reduce any gaps around the aperture 57 of the garage 50, which may lead to improved water repellent properties. In contrast, previous designs had poor engagement because there was a large gap between the slider and the hood of previous systems, which may have caused problems with water repellant properties. Certain embodiments of the present invention provide male slider caps 30 that contact the garage 50, which improves engagement and may additionally lead to improved water repellent properties.

As shown in FIGS. 3A and 3B, the water repellent properties may be improved even further by increasing the distance in which the male slider cap 30 is inserted into the garage 50. Increasing the insertion distance also provides for a more secure fit between the male slider cap 30 and the garage 50. The increased insertion distance may be accomplished in several ways. First, in some embodiments there may be provided a notch 58 in the garage 50. The notch 58 is dimensioned to receive the crown 46 of the male slider cap 30, and allows the male slider cap 30 to be docked more fully in the garage 50. The notch 58 may optionally include a hood 60 to cover any open spaces that are formed along the perimeter of the notch 58. Second, in some embodiments there may be provided an increased distance (d2) between the leading edge 40 of the male slider cap 30 and where the crown 46 attaches to the male slider cap 30. As the distance (d2) increases so does the surface area that is in contact between the garage 50 and the male slider cap 30, thus improving water repellent properties and securing the fit between the male slider cap 30 and the garage 50. As one of skill in the art will understand, if the distance (d2) is too long, then the water repellent properties may tend to suffer.

Figure 4A:
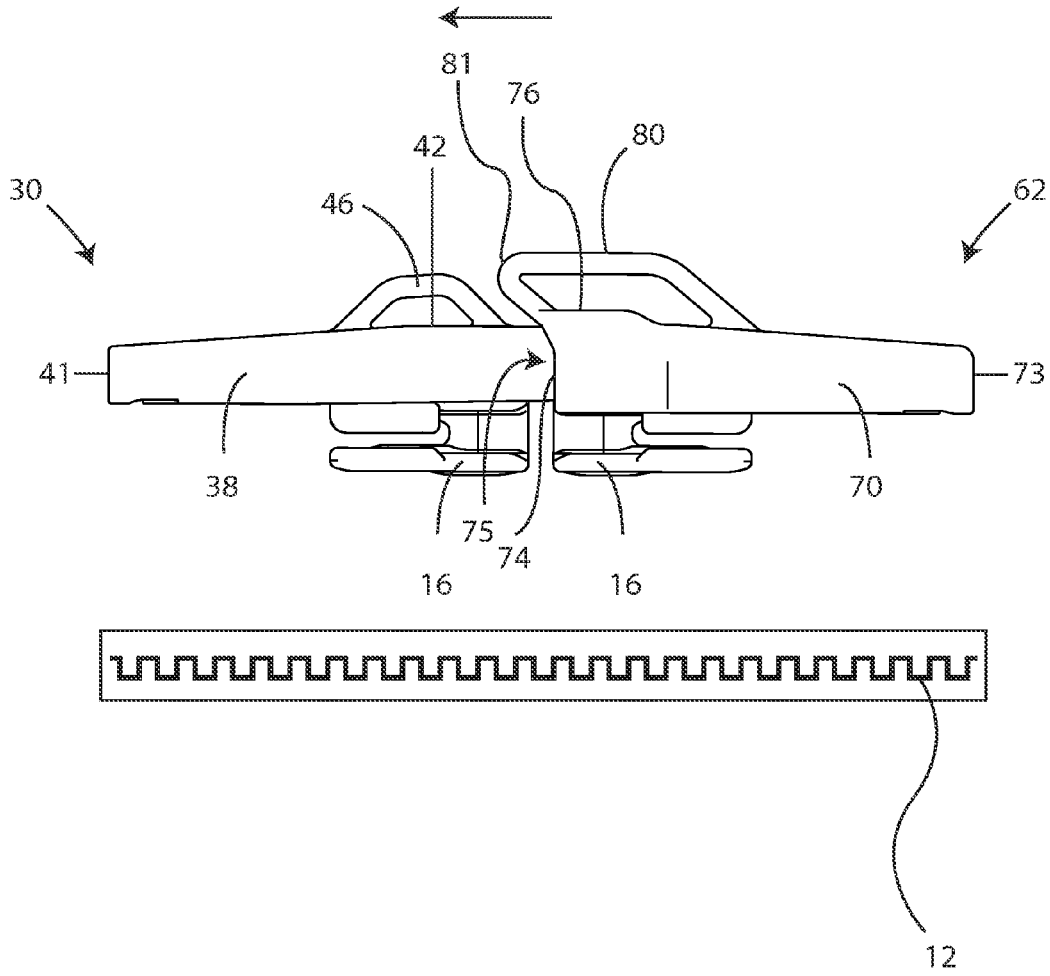
FIG. 4A shows a female slider cap docked with a male slider cap according to certain embodiments of the invention.
Figure 4B:
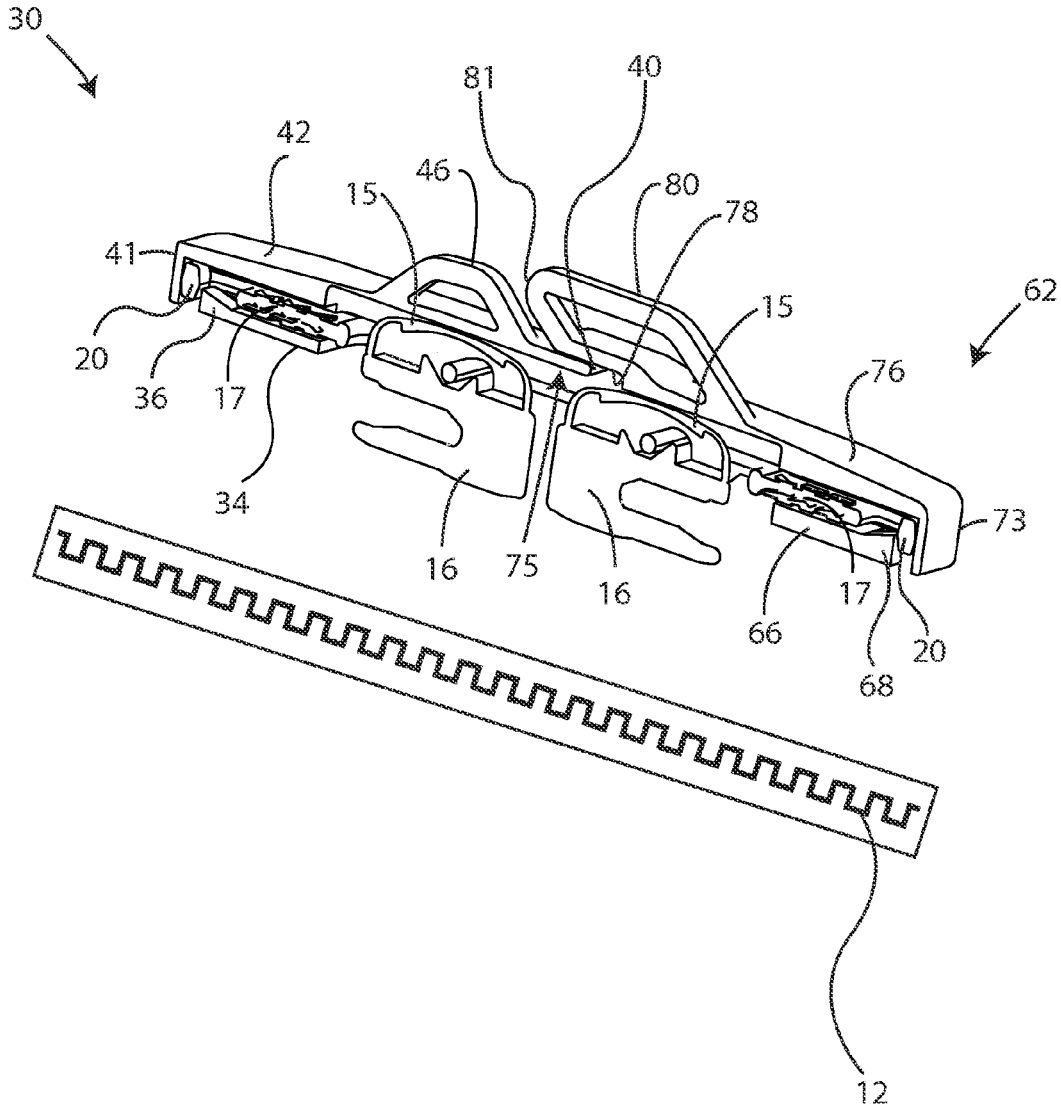
FIG. 4B shows a cross-sectional view of the mating male and female slider caps as shown in FIG. 4A.

As illustrated in FIGS. 4-6, certain embodiments of the invention include a female slider cap 62 that mates with the male slider cap 30 that may be used for two sliders 16 that meet in a head-to-head configuration on zipper tape 12. The zipper tape 12 that is shown in FIGS. 4 and 5 is shown slightly below (and not attached to) the sliders 16 for illustration purposes only in order to more clearly show the design of the sliders 16 and the slider caps 30, 62. It should be understood that in actual application, the sliders 16 are attached to the zipper tape 12.

The water repellent properties of the female slider cap 62 are similar to those described above with respect to the male slider cap 30. For example, the female slider cap 62 covers the slider 16 and prevents water from entering any openings that might be formed around the perimeter of the slider 16. As the size of the female slider cap 62 increases, so does the size of the perimeter around the slider 16 that is covered and protected by the female slider cap 62. But as one of skill in the art will understand, if the size of the female slider cap 62 is too large, then the water repellent properties may tend to suffer.

But additionally, the female slider cap 62 provides increased water repellent properties for two sliders 16 that meet in a head-to-head configuration. When two sliders 16 meet in a head-to-head configuration, an open space may be formed around the point of contact between the two sliders 16. Thus, as shown in FIG. 4A, the female slider cap 62 may include a domed outer surface 76 that is dimensioned to receive the leading edge 40 of the male slider cap 30, and to create an "awning" around the points of contact between the two sliders 16, thus covering any open spaces that might be formed where the two sliders 16 meet. Specifically, the outer surface 76 of the female slider cap 62 slides up and over the outer surface 42 of the male slider cap 30. Thus, the inner surface 78 of the female slider cap 62 contacts the outer surface 42 of the male slider cap 30. The sidewalls 70 of the female slider cap 62 also shroud the sidewalls 38 of the male slider cap 30. Thus, this "awning" design of the female slider cap 62 provides increased water repellent properties for two sliders 16 that meet in a head-to-head configuration. The awning design is also an improvement from known designs that required a third element (other than the male or female slider cap 30, 62) to provide water repellent properties. In certain embodiments of the present invention, the female slider cap 62 itself (and docking with the male slider cap 30) provides the water repellent properties.

Figure 6C:
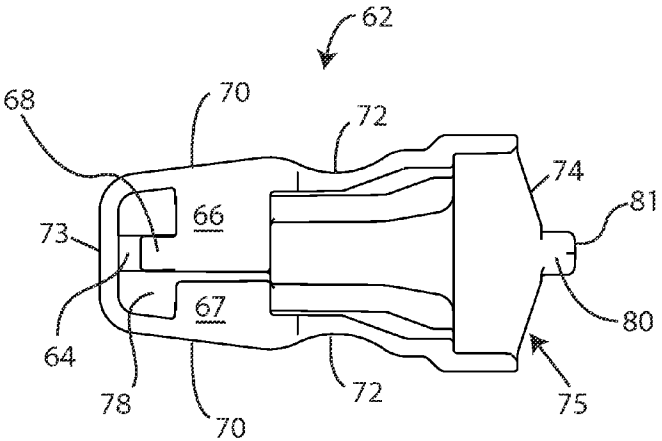
FIGS. 6A-D show various views of a female slider cap according to some embodiments of the invention.
Figure 6D:
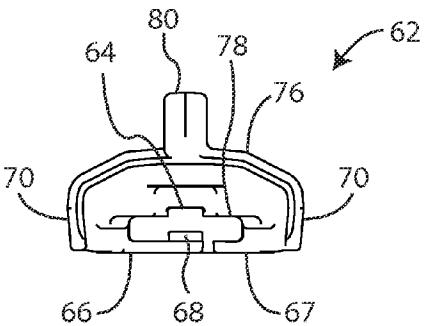
Figure 6A:
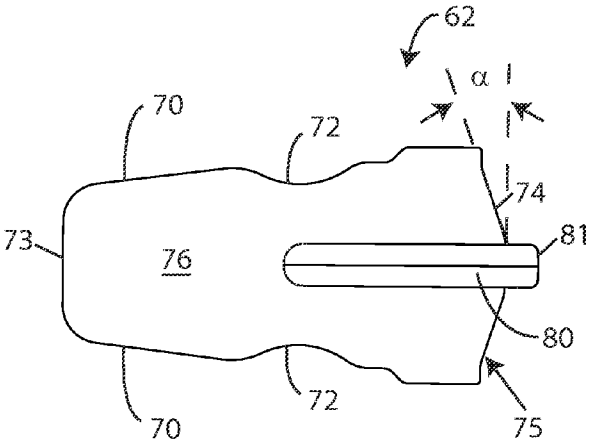
Figure 6B:
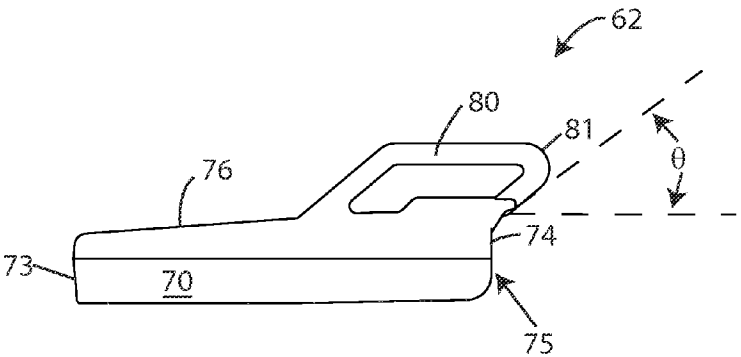

As shown in the figures, in certain embodiments the female slider cap 62 includes a crown 80 to receive a cord puller 82. The crown 80 of the female slider cap 62 (the "female crown") may be shaped and positioned differently than the crown 46 of the male slider cap 30 (the "male crown"). Specifically, the female crown 80 may be shaped like a diamond lying on its side such that the leading edge 81 of the female crown 80 protrudes over the leading edge 74 of the female slider cap 62. As illustrated in FIGS. 6A and 6C, in certain embodiments the leading edge 81 of the female crown 80 may extend at angles $\theta$ between 10-20 degrees as measured from the outer surface 76 of the female slider cap 62. Also, the leading edge 74 of the female slider cap 62 may be pointed so that the leading edge 74 extends beyond the rest of the female slider cap 62. In certain embodiments the leading edge 74 may be pointed at angles $\alpha$ between 5-10 degrees. It should be understood that the leading edge 74 may be domed, curved, or any other extending shape and the invention is not limited to only "pointed" leading edges. The leading edge 74 allows the female crown 80 to extend even further out from the female slider cap 62.

Figure 5A:
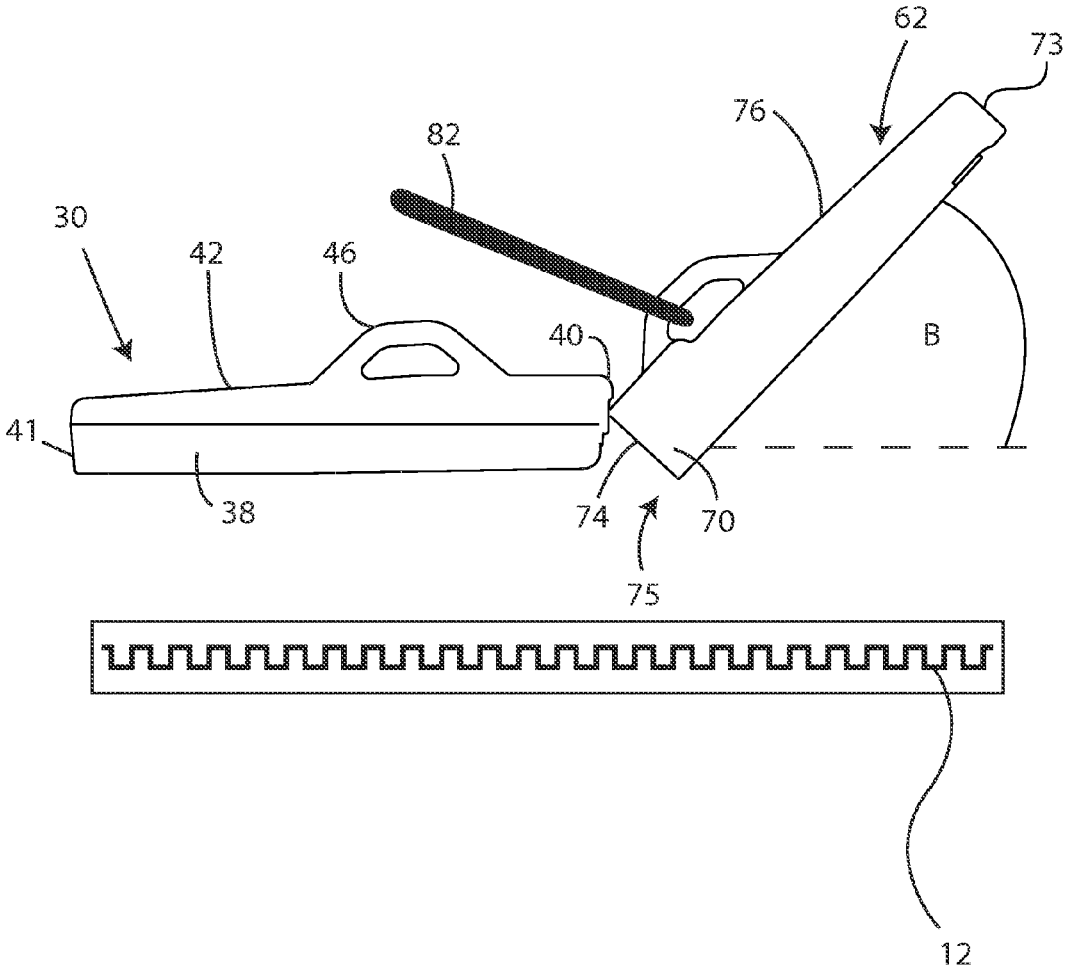
FIG. 5A shows the pivot angle created by a slider cap without certain features as described herein.

The shape of the female crown 80 facilities zipping and helps to ensure a secure fit between the male and female slider caps 30, 62. For example, FIG. 5A illustrates a pivot angle B that is formed when a zipper having a female slider cap 62 without an extended female crown 80 is engaged. Without an extended female crown 80, the pivot angle B is increased such that the sidewalls 70 of the female slider cap 62 drag on the zipper tape 12, making it difficult to engage the zipper. Additionally, the increased pivot angle B causes the outer surface 76 of the female slider cap 62 to be misaligned underneath the male slider cap 30. Thus the user must re-position the female slider cap 62 in the proper position over the male slider cap 30 (the proper position is shown in FIG. 4A).

Figure 5B:
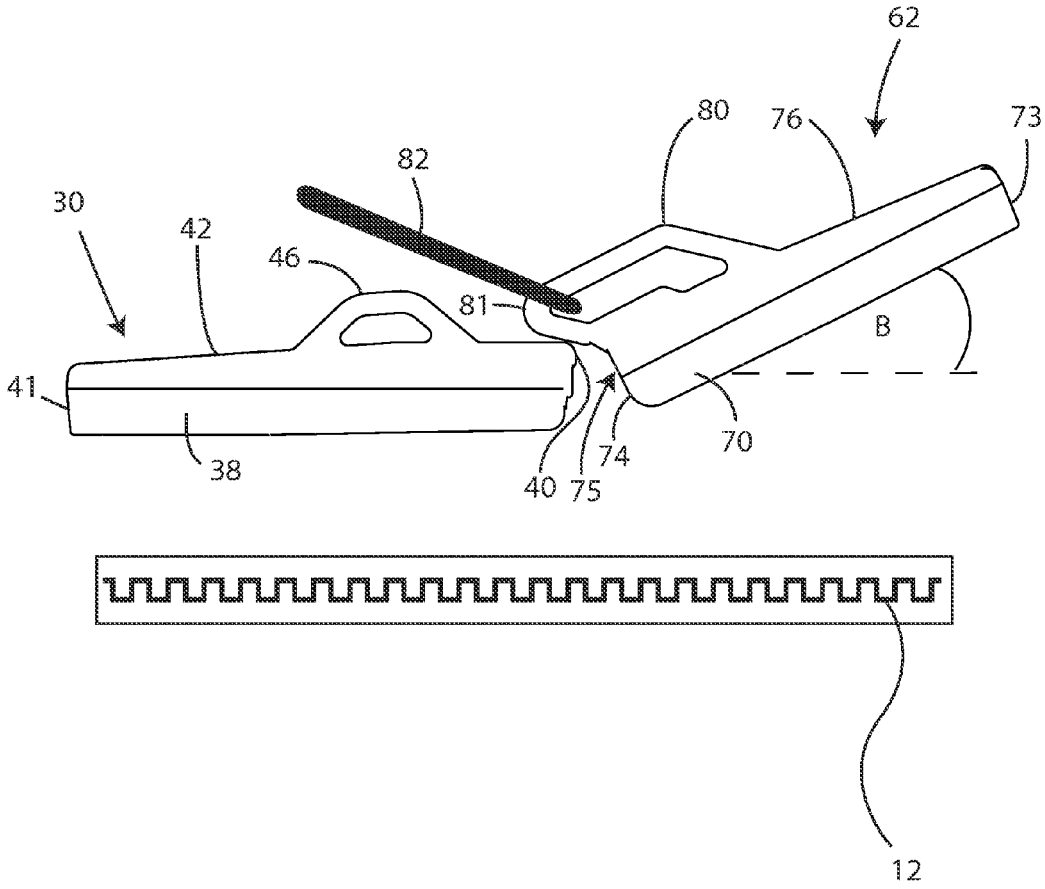
FIG. 5B shows the pivot angle created by female slider caps according to certain embodiments.

In contrast, as shown in FIG. 5B, embodiments having an extended female crown 80 reduce the pivot angle B, thus making it easier to engage the zipper. Moreover, the extended female crown 80 and the pointed leading edge 74 are not improperly pushed underneath the male slider cap 30. Rather, the extended female crown 80 and the pointed leading edge 74 actually push the leading edge 40 of the male slider cap 30 down. Pushing down the male slider cap 30 facilitates proper alignment, because as illustrated in FIG. 4A the male slider cap 30 is designed to be received in the female slider cap 62.

As illustrated in FIGS. 6A-6D, the female slider cap 62 includes many of the same features as the male slider cap 30. For example, the female slider cap 62 also includes a snap tab 66, 67, a ramp 68, sidewalls 70, an optional concave portion 72, trailing wall 73, outer surface 76, inner surface 78, and crown clearance portion 64 as described above with respect to the male slider cap 30. Additionally, the female slider cap 62 may be composed of the same materials and made by the same manufacturing process as described above with respect to the male slider cap 30.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

For example, any type of slider 16 may be used in embodiments of the invention, including either locking or non-locking sliders 16. The zipper 10 may be any type of zipper, including but not limited to water repellent zippers or non-water repellent zippers. The zippers may be of any size, including but not limited to traditional No. 5 or No. 8 zippers. Changing the type and size of the slider 16 and/or zipper 10 may result in changes to the dimensions of the slider caps 30, 62 or garage 50 or other zipper components described herein.

The invention claimed is:

1. A water repellent zipper assembly comprising:

water repellent zipper tape having a first end and a second end;

a slider comprising a leading edge and a pull tab, wherein the slider is positioned on the zipper tape with the leading edge facing the first end of the zipper tape;

a slider cap comprising an outer surface, an inner surface opposite the outer surface, a leading edge, a first sidewall adjacent to the leading edge, a second sidewall adjacent to the leading edge and opposite the first sidewall, and a snap tab extending between at least a portion of an inner surface of the first and second sidewalls, wherein the inner surface of the slider cap and the snap tab define a pocket that receives the pull tab of the slider; and a garage comprising an outer surface, an inner surface opposite the outer surface, at least three sidewalls, and an aperture, wherein the garage is attached to the zipper tape with the aperture facing the second end of the zipper tape, and wherein the outer surface of the slider cap covers the slider and the leading edge of the slider cap extends beyond the leading edge of the slider, and at least a portion of the inner surface of the garage contacts at least a portion of the outer surface of the slider cap when the leading edge of the slider cap is inserted into the aperture of the garage.

2. The assembly of claim 1, wherein the slider cap is comprised of a first material, and the garage is comprised of a second material, and wherein the first material is harder than the second material.

3. The assembly of claim 1, wherein the slider cap is comprised of a first material, and the garage is comprised of a second material, and wherein the first material has a lower coefficient of friction than the second material.

4. The assembly of claim 1, wherein the garage is comprised of at least one of rubber, silicone, fabric, or laminated fabric.

5. The assembly of claim 1, wherein the leading edge of the slider cap extends a distance d1 beyond the leading edge of the slider, and the leading edge of the slider cap is inserted into the aperture of the garage by a distance of at least d1.

6. The assembly of claim 1, wherein the outer surface of the slider cap comprises a crown on which to affix a cord puller, and the garage further comprises a notch to receive the crown when the leading edge of the slider cap is inserted into the aperture of the garage.

7. The assembly of claim 6, wherein the garage further comprises a hood to cover the notch.

* * * * *

UNITED STATES PATENT AND TRADEMARK OFFICE

CERTIFICATE OF CORRECTION

PATENT NO. : 8,375,528 B2
APPLICATION NO. : 12/628813
DATED : February 19, 2013
INVENTOR(S) : Shigeyoshi Takazawa et al.

It is certified that error appears in the above-identified patent and that said Letters Patent is hereby corrected as shown below:

On the Title page, in item (75), in "Inventors", in column 1, line 1, Delete "GA" and insert -- CA --, therefor.

Signed and Sealed this
Fourteenth Day of May, 2013

Teresa Stanek Rea
*Acting Director of the United States Patent and Trademark Office*